United States Patent [19]

Zadiraka

[11] 4,433,646

[45] Feb. 28, 1984

[54] BOILER WATER TRIP SYSTEM

[75] Inventor: Allan J. Zadiraka, Akron, Ohio

[73] Assignee: The Babcock & Wilcox Company, New Orleans, La.

[21] Appl. No.: 419,112

[22] Filed: Sep. 16, 1982

[51] Int. Cl.[3] ..... F22B 37/42

[52] U.S. Cl. ..... 122/504.2; 122/451 S; 122/504

[58] Field of Search ..... 122/451 R, 451 S, 451.1, 122/451.2, 504, 504.2

[56] References Cited

U.S. PATENT DOCUMENTS

| | | | |
|---|---|---|---|
| 3,175,541 | 3/1965 | Hottenstine | 122/451 S |
| 3,196,844 | 7/1965 | Sulzer | 122/451.1 X |
| 3,828,738 | 8/1974 | Frei | 122/504.2 |
| 4,084,547 | 4/1978 | Deziel | 122/504 |
| 4,144,846 | 3/1979 | Miszak | 122/451 S |

FOREIGN PATENT DOCUMENTS

| | | | |
|---|---|---|---|
| 830128 | 4/1979 | U.S.S.R. | 122/504.2 |

*Primary Examiner*—Edward G. Favors
*Attorney, Agent, or Firm*—Vytas R. Matas; Robert J. Edwards

[57] ABSTRACT

A boiler water trip system comprises a flow transmitter for sensing a flow of water into a boiler, a pressure transmitter for sensing a pressure of steam entering a first stage of a turbine powered by the boiler, a unit power transmitter for sensing the power generated by the turbine, a feeder water temperature transmitter and a drum level transmitter for sensing the level of water in a steam drum connected to the boiler. Function generators are connected to the pressure and unit load transmitters for obtaining a measure of flow out of the boiler. The higher of the two flow values are compared with the feed water flow to the boiler to generate an error signal which is integrated. The integrated error signal corresponds to a calculated boiler water level amount. If the boiler water level rises above or falls below set limits and, simultaneously, a drum level rises above or falls below said amounts as determined by the drum level transmitter, a tripper is activated to trip the boiler. The flow error signal and the integrater are connected to a unit for determining whether the drum level has risen above or fallen below its set limits to push the flow error signal toward a correct value when there is no actual flow error between the feed water to the boiler and flow out of the boiler.

9 Claims, 4 Drawing Figures

BOILER WATER TRIP SYSTEM

FIELD AND BACKGROUND OF THE INVENTION

The present invention relates in general to boilers and in particular to a new and useful boiler water trip system which utilizes the integral of a calculated boiler water level signal to generate a time delay for applying a drum level signal to a tripper for tripping the boiler when the drum level signal indicates the presence of water in the drum at too high and too low a level.

Boilers which generate steam from boiling water and utilize steam drums are known. It is known to provide the steam drums with level transmitters or sensors that generate a signal when water in the drum is at too high or too low a level. At this point equipment connected to the boiler become operable to trip the boiler and terminate dangerous boiler activity.

A boiler trip must be generated when the drum water level drops below the lowest permissible water level at which the boiler can be safely operated. A boiler trip should also be generated when high drum water level exceeds the point at which cyclones that are used with the boiler may be flooded and result in carry-over.

Since drum level is subject to transient variations, instantaneous trips on drum level would result in excessive false trips of the boiler which are not acceptable to operating companies. Normally, a boiler trip signal from drum level equipment is generated from the high or low drum level trip point being exceeded for a fixed period of time. Establishing this time period involves compromises. If the time is set to provide protection under a worst case failure, it may be too short to allow the controls or operator to correct for a less severe failure. Yet if it is set longer to allow time for the controls or operator to correct the problem, it may be too long to protect the boiler under all conditions.

For additional information concerning boiler and drum structure as well as controls therefor see *Steam, Its Generation and Use,* 39th Ed., Babcock and Wilcox Co., 1978.

SUMMARY OF THE INVENTION

The present invention is drawn to a system for tripping a boiler based on a drum level signal. The boiler is tripped however, only after the signal has indicated a too high or too low drum level for a period of time as adjusted by the integral of a flow error. The flow error is obtained as the difference between an amount of feed water flowing into the boiler and an amount of steam unit load output by the boiler. In this way the time delay for activating a tripper according to a drum level signal is tailored to the flow condition within the boiler so that a tripping which is too early or too late is avoided.

Accordingly, an object of the present invention is to provide a boiler water level trip system for a boiler having a drum with an upper and lower water level limit comprising, tripping means connected to the boiler for tripping an operation of the boiler upon the occurrence of a trip signal, a feed water flow transmitter for sensing flow into the boiler, a drum level transmitter for sensing water level in the drum, a steam pressure transmitter for sensing first stage steam pressure in the turbine, a function generator connected to the pressure transmitter for generating a flow value out of the boiler corresponding to the steam pressure, a comparator connected to the flow transmitter and the function generator for generating a flow error signal, an integrator connected to the comparator for integrating the flow error signal to generate a boiler level signal corresponding to a level of water in the boiler, a first high/low indicator connected to the integrator having terminals for carrying a high level indication signal and a low level indication signal when a high and low water level occurs in the boiler, a second high/low indicator connected to the level transmitter having terminals for carrying high and low level indication signals upon the occurrence of high and low water levels in the drum, a first AND gate connected to the high level indication signal terminals of the high/low indicators and a second AND gate connected to the low level indicator signal terminals of the high/low indicators, and an OR gate connected to an output of the first and second AND gates and having an output connected to the tripping means, the OR gate generating the trip signal upon the simultaneous occurrence of a high water level in the boiler and the drum or a low level occurrence in the boiler in the drum.

A further object of the invention is to provide such a system which includes a means for factoring the flow error to push it toward a high or low level indication which means are controlled by a high or low level signal from the drum level transmitter.

A still further object of the invention is to provide such a system wherein the boiler drives a turbine that generates a load, including a unit load transmitter connected to the turbine for sensing a load on the turbine, a further function generator connected to the load transmitter for converting the load to a flow value out of the boiler and a selector connected to the output of the first mentioned and further function generators for selecting a higher flow value from the two function generators to be supplied to the comparator for comparison with the sensed water flow into the boiler.

Another object of the invention is to provide such a system wherein the OR gate has an additional input connected to a selected time delay which receives a high or low signal from an additional high/low indicator connected to the level transmitter, and applies the high or low level indication to the OR after the selected time delay for the purposes of generating the trip signal.

Another object of the invention is to provide a boiler water load trip system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
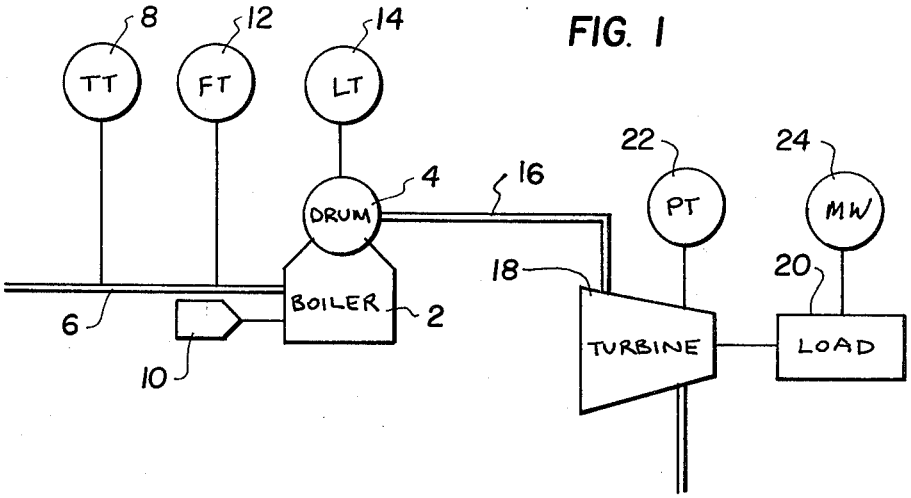
FIG. 1 is a schematic block representation of a boiler to be provided with the water level trip system of the invention.

Referring to the drawings, in particular the invention embodied therein, in FIG. 1 comprises a boiler water level trip system for tripping the operation of a boiler 2 having a drum 4 with the aid of tripping means 10 that receive a trip signal. The water feed line 6 of boiler 2 is provided with a temperature transmitter 8 and a feed water flow transmitter 12. The drum is provided with drum water level transmitter 14. A steam line 16 connects drum 4 to a turbine 18 which drives the load 20. First stage steam pressure is sensed by a pressure transmitter 22 and unit load is sensed by a load transmitter 24.

Figure 2:
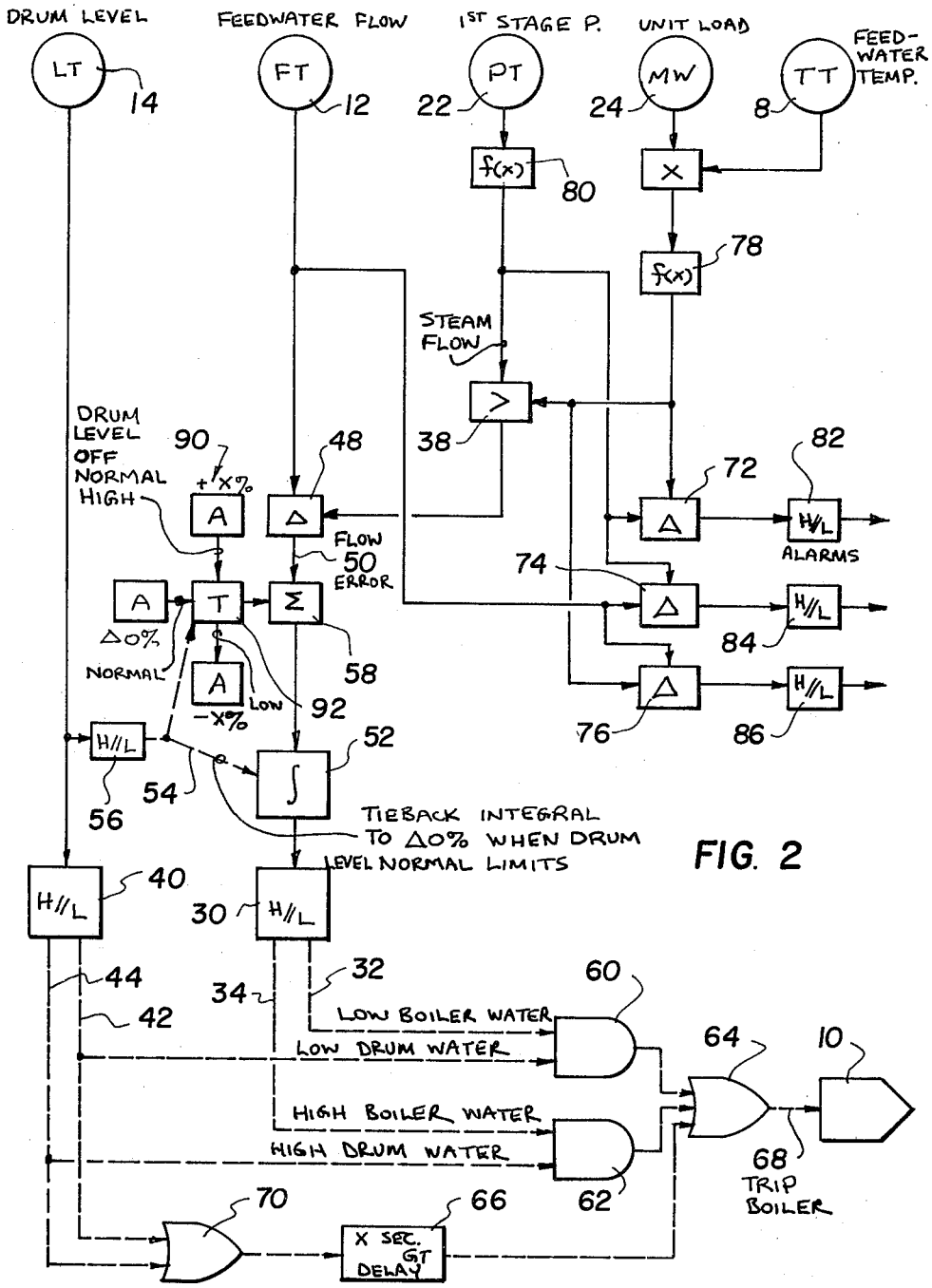
FIG. 2 is a block diagram showing the inventive system.

FIG. 2 shows a system for tripping a boiler upon the occurrence of a boiler water level signal, which calculates the inlet-outlet flow unbalance which exists on the boiler and uses this flow unbalance to establish the allowable time before the boiler is tripped on the bases of drum level. Flow from the boiler is estimated from steam flow or unit load generated, depending on which is the higher, as determined in unit 38. Steam flow is calculated as a function of turbine first-stage pressure from pressure transmitter 22. Unit load equivalent flow is calculated from unit load generated from transmitter 24, which is MW's corrected for feedwater temperature from temperature transmitter 8. The flow from the boiler is compared to the boiler feedwater flow from flow transmitter 12, in a comparator 48, to generate a flow error on line 50, representing the boiler inlet-outlet flow unbalance. Depending on the cycle arrangement and the locations of the measurements, additional flow measurements may have to be included to account for flows which by-pass a measurement point such as water attemperator flows to the feedwater flow or saturated steam flow from the drum to the condenser to the turbine steam flow.

Figure 3:
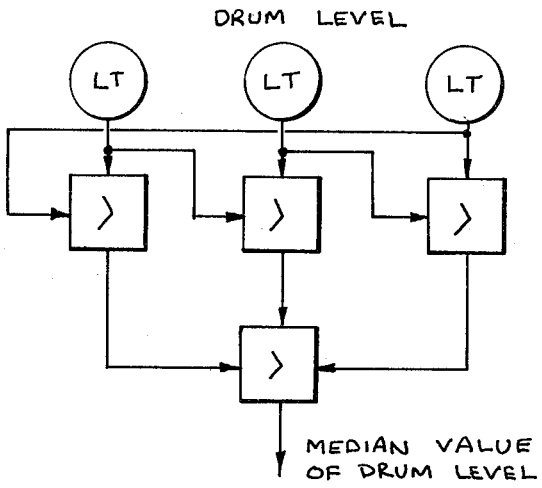
FIG. 3 is a block diagram showing an auctioneering scheme for for selecting a medium value from a plurality of transmitters used to obtain a particular value.

While FIG. 2 shows a single transmitter for each required measurement, use of three measurements for a variable with an auctioneering scheme to select the median value will provide increased reliability, since a transmitter failure will not prevent proper operation of the system or generate a false trip. FIG. 3 shows the use of three transmitters to obtain the median value of drum level. Since drum level is the actual tripping signal, the three redundant transmitter schemes should be used on drum level and may be used on the other measurements to improve the reliability of the system.

Figure 4:
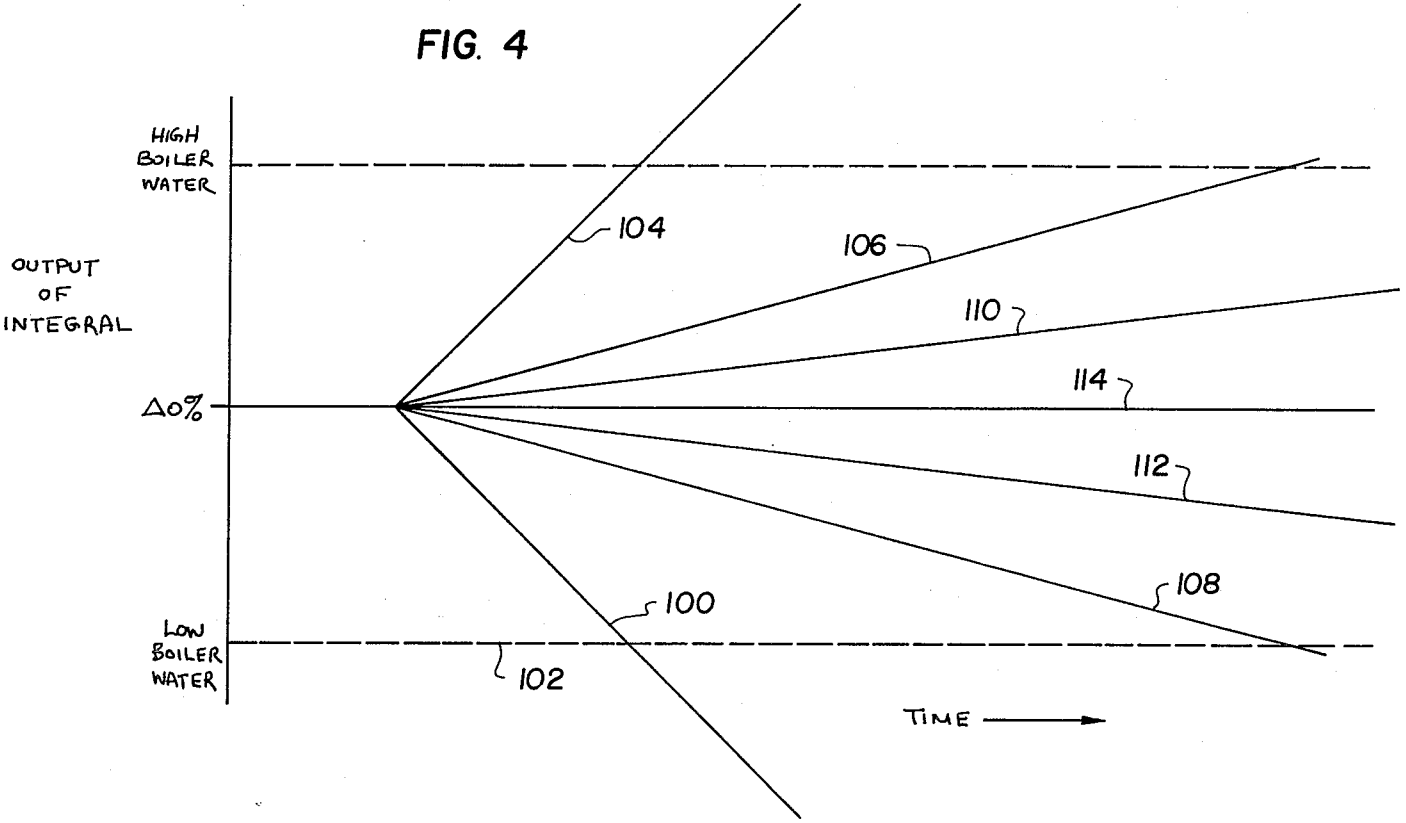
FIG. 4 is a graph showing the path taken by calculated boiler level values depending on the various conditions which may occur in the boiler or drum.

The flow error is integrated in integrator 52, with the output of the integral representing a calculated boiler water level. Since this arrangement does not necessarily result in a precise calculation of boiler water level over an extended period of time, the integral is forced to its mid-range value (Δ0%) by a connection 54 with the high/low level circuit or indicator 56, whenever drum level is close to its normal value to represent normal operating limits without a flow error, a fixed bias is added to the flow error by summation unit 58 to force the boiler water level calculation to go in the direction of the drum level error, even if no flow error exists. The action of the boiler water calculation integral under different flow errors is shown in FIG. 4.

When the boiler water level (as calculated) reaches either it high or low limit and the drum level is high or low, a boiler trip signal is generated at the output of AND gate 60. The length of time required for the integral to reach the high or low limit is a function of the integral rate, the amount of fixed bias which is added and the flow error. Since the integral of the flow error increases or decreases, the time interval before a drum level trip occurs.

If a boiler were operating normally with this system and a decrease in feedwater flow occurred, drum level would start dropping. Once drum level drops below its normal low limit, the integral would be released and the bias would force it to integrate toward the low boiler water level condition, as shown at line 100 in FIG. 4. The flow error will increase the rate at which the integral was moving toward the low boiler level point at line 102. The larger the flow error is, the less time required for the integral to reach the trip point. When both the drum level and the integral reach their trip point, a boiler trip will occur at tripper 10. If feedwater flow is increased or steam flow is decreased before both conditions reach their trip points, the time to trip will automatically compensate for the existing flow unbalance. If the flows are adjusted in a direction to restore drum level, the trip will be blocked even if drum level should transiently drop below its trip point. Since AND gate 60 would have only one plus input rather than the required two.

Since it is possible for a failure to occur such that drum level continues to drop, even though the flow unbalance is in the direction of restoring drum level, the trips from high or low drum level for a given period of time are retained; but the period can now be set sufficient to allow the controls or operator to correct the flow unbalance.

In FIG. 2, solid lines indicate analog signals whereas dotted lines indicate Boolean logic signals. The output of integrator 52 is connected to a high/low indicator 30 which has terminals for a low boiler water level signal and a high boiler water level signal connected to lines 32 and 34 respectively. Level transmitter 14 is also connected to a high low indicator 40 having terminals connected to lines 42 and 44, for low drum level and high drum level signals respectively. While AND gate 60 receives the low boiler water and low drum level signals a second AND gate 62 receives high boiler water and high drum level signals. The output of AND gates 60 and 62 are connected to an OR gate 64 which also has an additional terminal connected to a time delay 66. With the occurrence of simultaneous low or simultaneous high signals from boiler and drum a plus output is generated from either AND gate 60 or 62 to activate OR gate 64 and apply a trip signal over line 68 to tripping means 10. Time delay 66 is connected to its own OR gate 70 which has inputs connected to lines 42 and 44 to operate tripping means 10 which a selected time delay as a further safety feature.

Comparators 72,74 and 76 receive and compare signals from various points in the system to generate alarms if necessary.

Comparator 72 is connected to function generators 78 and 80 to receive the output flow signals corresponding to unit load and first stage turbine pressure respectively to generate an alarm over a high/low indicator 82 with the difference between these two values is unacceptably high. A high/low indicator 84 is connected to the output of comparator 74 which receives outputs from function generator 80 and feedwater flow transmitter 12. The unit load is compared to the feedwater flow in comparator 76 to activate a high/low indicator 86 if necessary.

Means 90 are connected to summing unit 58 to factor in, over a terminal 92, high/low and normal drum level quantities as well as the output of high/low indicator 56 to modify the flow error signal over line 50 as shown in FIG. 4.

In FIG. 4, line 104 shows the condition where drum level is high and feedwater flow is greater than steam flow. As noted above, line 100 is the case where drum level is low and steam flow is greater than feedwater flow. Line 106, factoring in a longer time delay, occurs when the drum level is off normal to the high side with no flow error and line 108 occurs when the drum level is off normal on the low side with no flow error. When drum level is high with steam flow being greater than feed water flow line 110 occurs and when drum level is low with feed flow water greater than steam flow, line 112 occurs. Line 114 shows the normal operating state of the boiler at normal drum level. FIG. 4 demonstrates the difference in delay time which is factored in according to the invention.

While a specific embodiment of the invention has been shown and described in detail to illustrate the application of the principles of the invention, it will be understood that the invention may be embodied otherwise without departing from such principles.

What is claimed is:

1. A boiler water level trip system for a boiler having a drum with an upper and lower water level limit comprising:

tripping means connected to the boiler for tripping the boiler operation upon the occurrence of a trip signal;

a feedwater flow transmitter for sensing flow into the boiler;

a drum level transmitter for sensing a water level in the drum;

a steam pressure transmitter for sensing steam pressure coming from the boiler;

a function generator connected to the pressure transmitter for converting the steam pressure in a first stage of a turbine into a flow value out of the boiler;

a comparator connected to said flow transmitter and to said function generator for generating a flow error signal corresponding to a difference in flow into and out of the boiler;

an integrator connected to said comparator for integrating said flow error signal to generate a boiler level signal corresponding to a level of water in the boiler;

a first high/low indicator connected to said integrator for generating high and low indication signals upon the occurrence of a boiler level signal above and below selected limits respectively, said first high/low indicator having output terminals for each of said high and low level indication signals;

a second high/low indicator connected to said level transmitter for generating high and low level indication signals upon the occurrence of upper and lower water levels in the drum, said second high/low indicator having output terminals for each of the high and low level indication signals;

a first AND gate having an input connected to each high level indication signal terminal of said first and second high level indicators and an output;

a second AND gate connected to the low level indication signal terminal of each of said first and second high/low indicators and having an output; and an OR gate having inputs connected to each of said first and second AND gate outputs and an output connected to said tripping means, said OR gate generating said trip signal upon the occurrence of a signal from either of said first and second AND gates.

2. A system according to claim 1, wherein the boiler powers a turbine which generates a load, further including a unit load transmitter for sensing the load, a further function generator connected to said unit load transmitter for converting the sensed load into a flow value out of the boiler, a selector connected to said first mentioned and further function generators for selecting the greater flow value out of the boiler and having an output connected to said comparator for applying the greater flow value to the comparator.

3. A system according to claim 2, including a feed water temperature transmitter and a proportioning unit connected to the feedwater temperature transmitter and the unit load transmitter for adjusting the sensed unit load for feed water temperature.

4. A system according to claim 1, or 2 including a time delay for applying a selected time delay to a signal, a second OR gate having an output connected to said time delay, said time delay having an output connected to an additional output of said first mentioned OR gate, said additional OR gate having two inputs each connected to one of said terminals of said second high/low indicator.

5. A system according to claim 1, or 2 including a summing connected between said comparator and said integrator and means connected to said summing unit for factoring in a value to said flow error when the drum water level is above and below a normal level.

6. A system according to claim 5, wherein said means includes a third high and low indicator connected to said drum level transmitter and to said integrator.

7. A system according to claim 2, including a second comparator having inputs connected to said first mentioned and further function generators and an output connected to alarm means for activating alarm upon the occurrence of an error above a selected limit between the flow values of said first mentioned and further function generators.

8. A system according to claim 7, including a third comparator having inputs connected to said first mentioned function generator and said feed water flow transmitter and an output connected to additional alarm means for activating alarm upon the occurrence of an error above a selected limit between said flow value out of the boiler and said flow into the boiler.

9. A system according to claim 8, including a fourth comparator connected to said further function generator and said feed water flow transmitter and having an output connected to alarm means for sounding an alarm upon the occurrence of an error above a selected limit between said flow value out of the boiler and said flow into the boiler.

* * * * *